US012612211B2

(12) United States Patent
Limousin et al.

(10) Patent No.: US 12,612,211 B2
(45) Date of Patent: Apr. 28, 2026

(54) FOLDABLE PARCEL COMPRISING MEANS FOR GUIDING A COVER

(71) Applicant: PA.COTTE SA, Pully (CH)

(72) Inventors: Damien Limousin, Saint Etienne de Montluc (FR); Simon Guilloux, Nantes (FR)

(73) Assignee: PA.COTTE SA, Pully (CH)

( * ) Notice: Subject to any disclaimer, the term of this patent is extended or adjusted under 35 U.S.C. 154(b) by 0 days.

(21) Appl. No.: 18/287,418

(22) PCT Filed: Apr. 8, 2022

(86) PCT No.: PCT/EP2022/059486
§ 371 (c)(1),
(2) Date: Oct. 18, 2023

(87) PCT Pub. No.: WO2022/223326
PCT Pub. Date: Oct. 27, 2022

(65) Prior Publication Data

US 2024/0199273 A1 Jun. 20, 2024

(30) Foreign Application Priority Data

Apr. 22, 2021 (FR) ..... 2104210

(51) Int. Cl.
*B65D 6/18* (2006.01)
*B65D 43/16* (2006.01)

(52) U.S. Cl.
CPC ..... *B65D 11/1833* (2013.01); *B65D 43/16* (2013.01)

(58) Field of Classification Search
CPC .... B65D 11/1833; B65D 43/16; B65D 19/12; B65D 19/0026; B65D 19/10; B65D 21/083; B65D 2501/24184
(Continued)

(56) References Cited

U.S. PATENT DOCUMENTS 1,230,831 A * 6/1917 Ickes ..... B65D 11/1833 220/7
2,906,428 A 9/1959 Fralick
(Continued)

FOREIGN PATENT DOCUMENTS

| | | |
|---|---|---|
| CN | 205952653 | 2/2017 |
| FR | 2288035 | 5/1976 |
| WO | 2014/051436 | 4/2014 |

OTHER PUBLICATIONS

International Search Report and Written Opinion as issued by the International Searching Authority, for International Patent Application No. PCT/EP2022/059486; 13 pages.
(Continued)

*Primary Examiner* — Orlando E Aviles
*Assistant Examiner* — Brijesh V. Patel
(74) *Attorney, Agent, or Firm* — Faegre Drinker Biddle & Reath LLP

(57) ABSTRACT

A foldable parcel is disclosed, which can transition between a use configuration, where a bottom and surrounding panels form a box, and a flat configuration, where the panels and a cover lie substantially parallel to the bottom. The parcel includes a locking mechanism that secures the cover in a closured position by forming a mechanical connection between the upper edge of the front panel and a front edge of the cover. It also includes a guide mechanism that assists in positioning the cover into its closed position.

7 Claims, 7 Drawing Sheets

(58) Field of Classification Search
USPC .... 220/1.5, 4.01, 4.29, 4.32, 4.34, 6, 7, 556, 220/660, 811; 206/204, 386, 562, 597, 206/600; 108/51.3, 53.1, 53.3, 57.1, 108/57.28, 901
See application file for complete search history.

(56) References Cited

U.S. PATENT DOCUMENTS 3,730,378 A * 5/1973 Albinson ..... B65D 7/12 312/328
5,076,457 A * 12/1991 Marovskis ..... B65D 11/1833 220/6
5,324,105 A * 6/1994 Christensen ..... B65D 25/10 206/335
6,202,922 B1 * 3/2001 Phillips ..... B65F 1/062 220/908
6,557,958 B1 * 5/2003 Motta ..... E05D 15/42 312/319.2
6,863,358 B2 * 3/2005 Beyer ..... E06B 3/482 312/297
7,712,848 B1 * 5/2010 Frost-McKinley .... A47B 67/04 312/240
8,651,309 B2 * 2/2014 Gualersi ..... B65D 11/1833 220/613
9,365,321 B2 * 6/2016 Wu ..... B65D 25/38
10,316,580 B2 * 6/2019 Shimizu ..... A47B 81/00
10,940,976 B2 * 3/2021 Goddard ..... B65D 19/18
2004/0100171 A1 * 5/2004 Brown ..... E06B 3/5045 312/322
2008/0218043 A1 * 9/2008 Gianelo ..... A47B 43/00 312/319.2
2009/0159593 A1 * 6/2009 Apps ..... B65D 11/1833 220/6
2015/0027917 A1 * 1/2015 Goddard ..... B65D 19/18 206/386

OTHER PUBLICATIONS

English translation of International Search Report as issued by the International Searching Authority, for International Patent Application No. PCT/EP2022/059486; 2 pages.
English translation of the International Preliminary Report on Patentability issued by the International Searching Authority, dated Oct. 24, 2023, for International Patent Application No. PCT/EP2022/059486; 9 pages.

* cited by examiner

[Fig. 1]
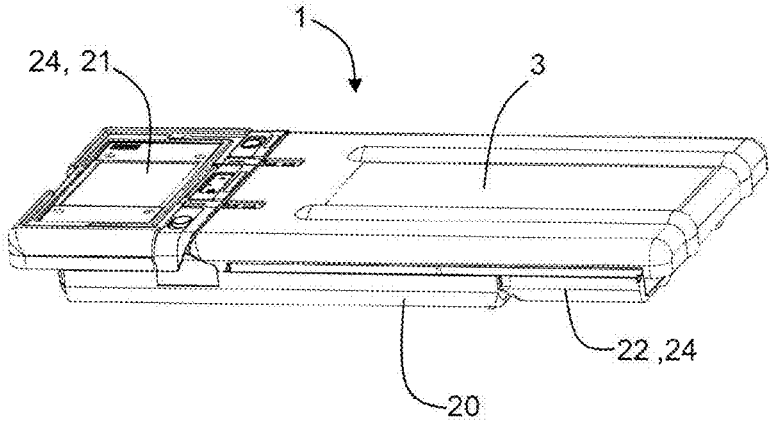
[Fig. 2]
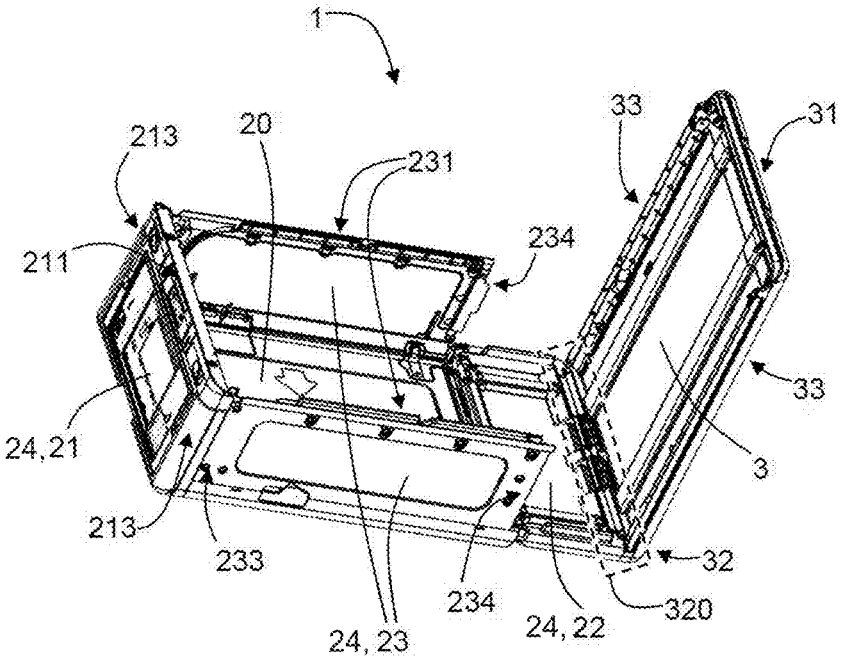

[Fig. 3]
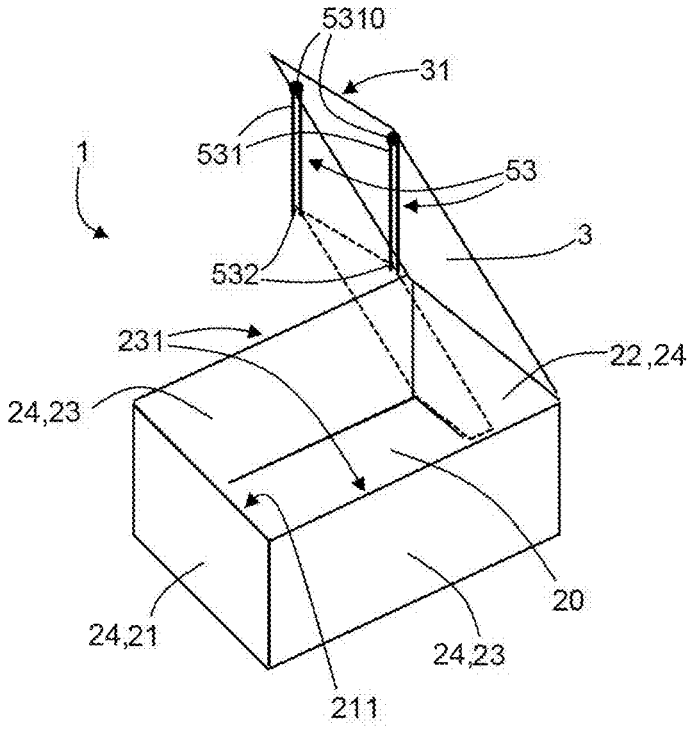
[Fig. 4]
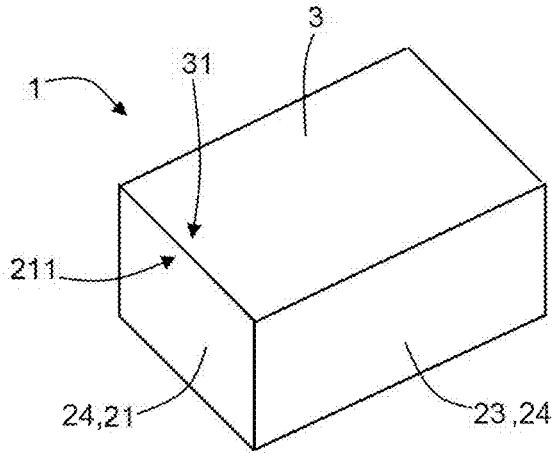

[Fig. 5]
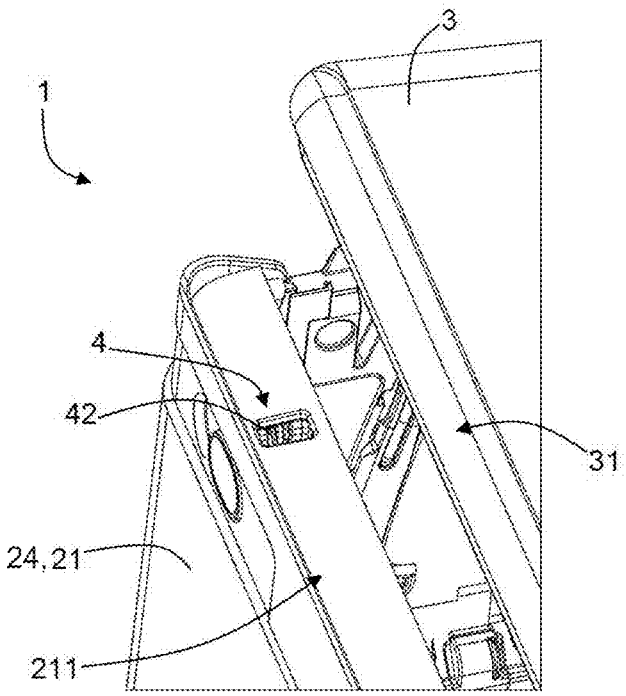
[Fig. 6]
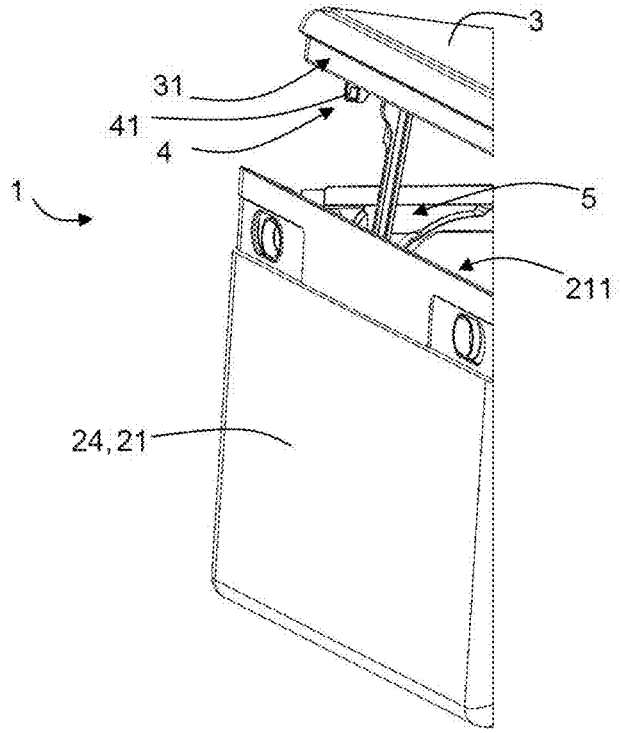

[Fig. 7]
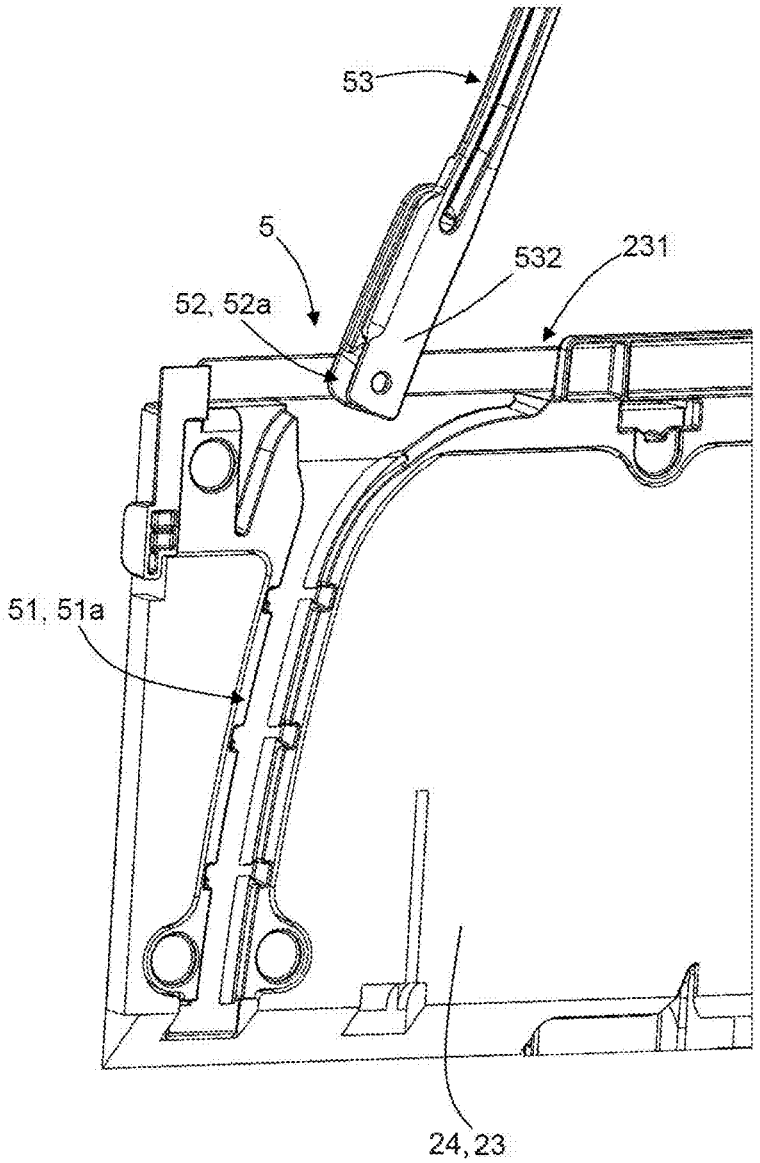

[Fig. 8]
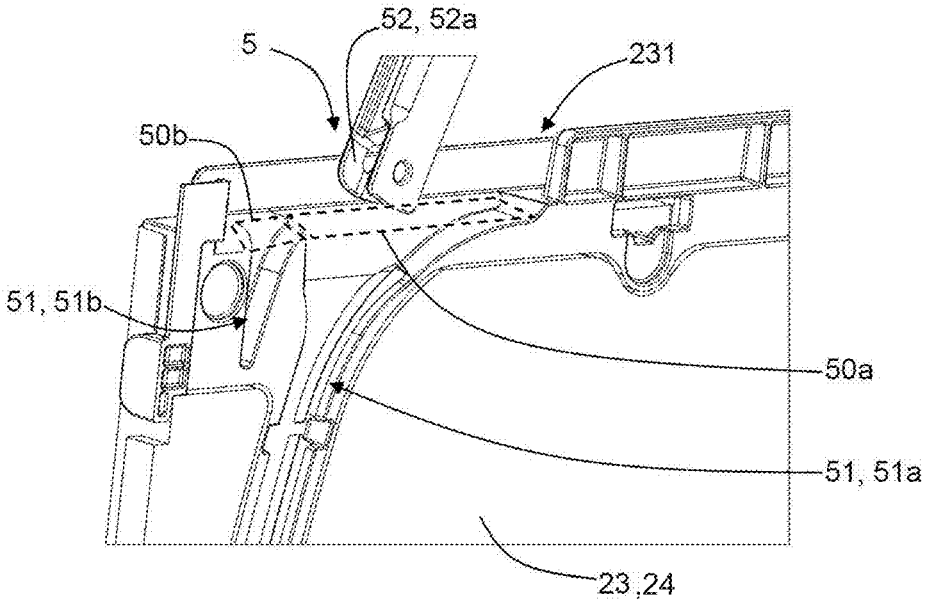
[Fig. 9]
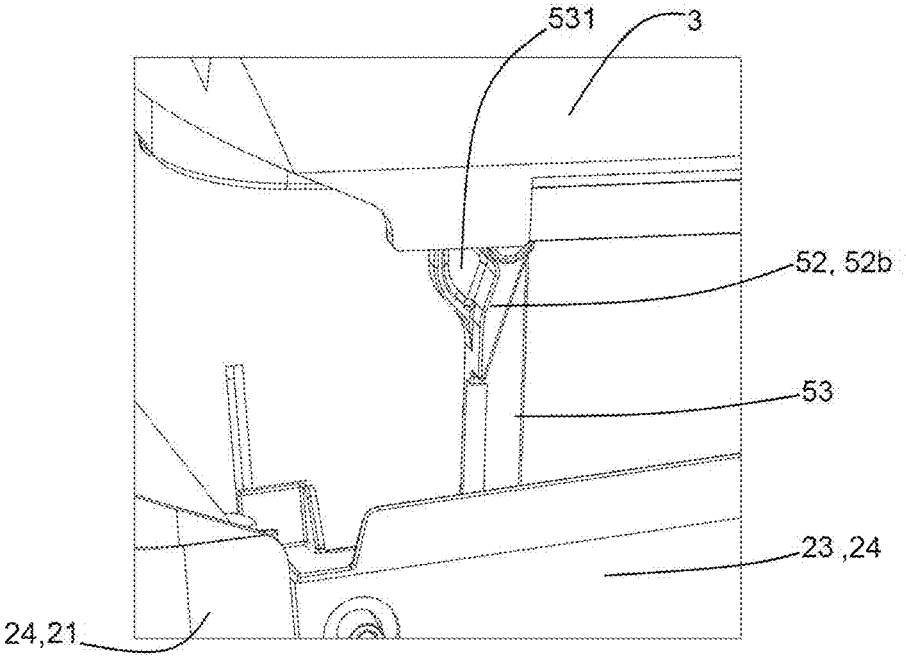

[Fig. 10]
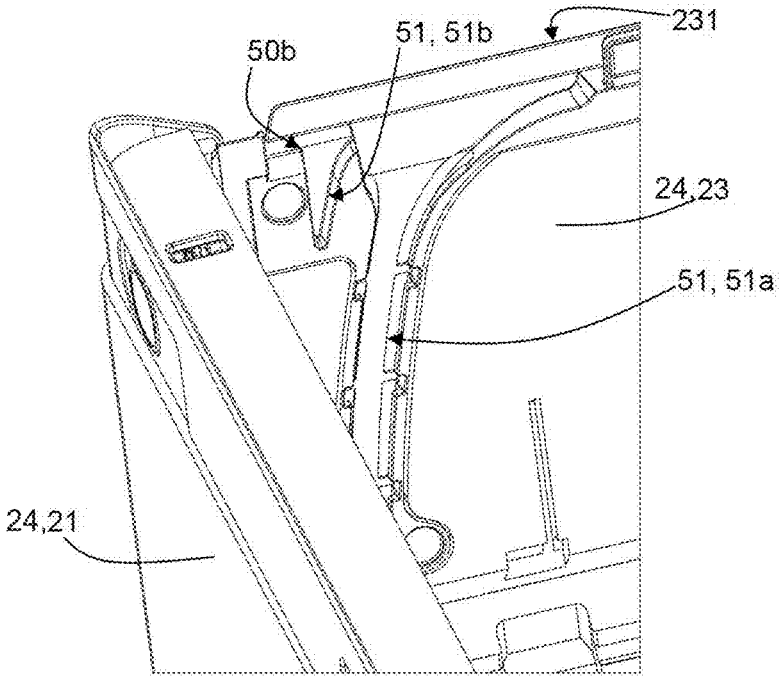
[Fig. 11]
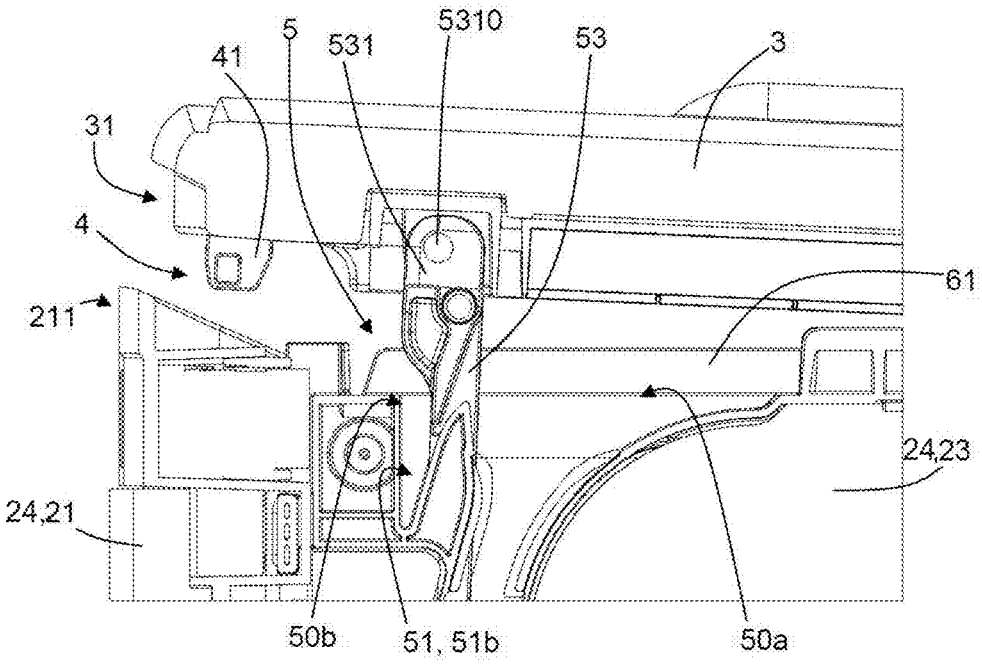

[Fig. 12]
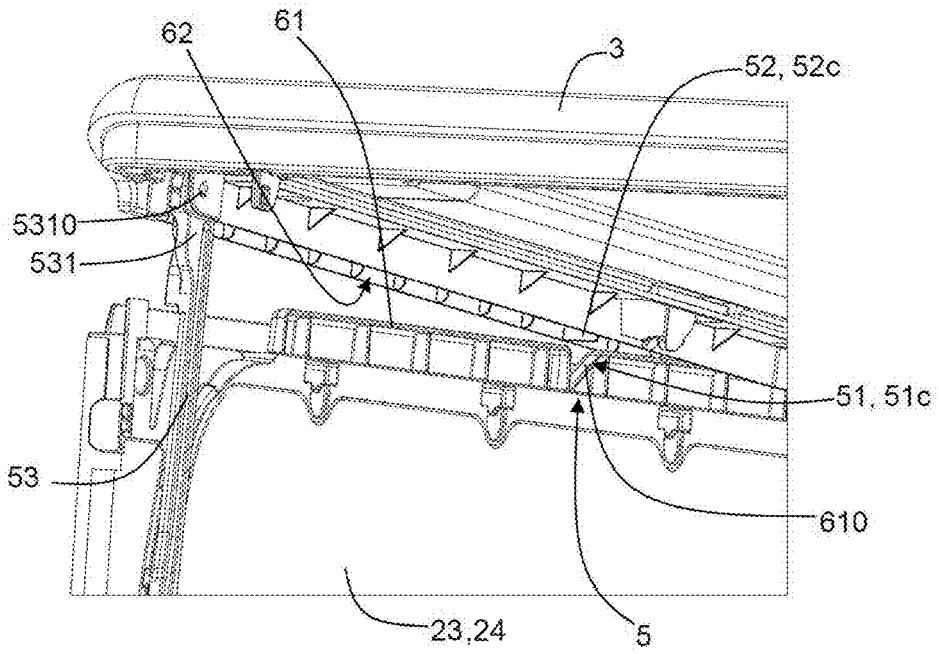
[Fig. 13]
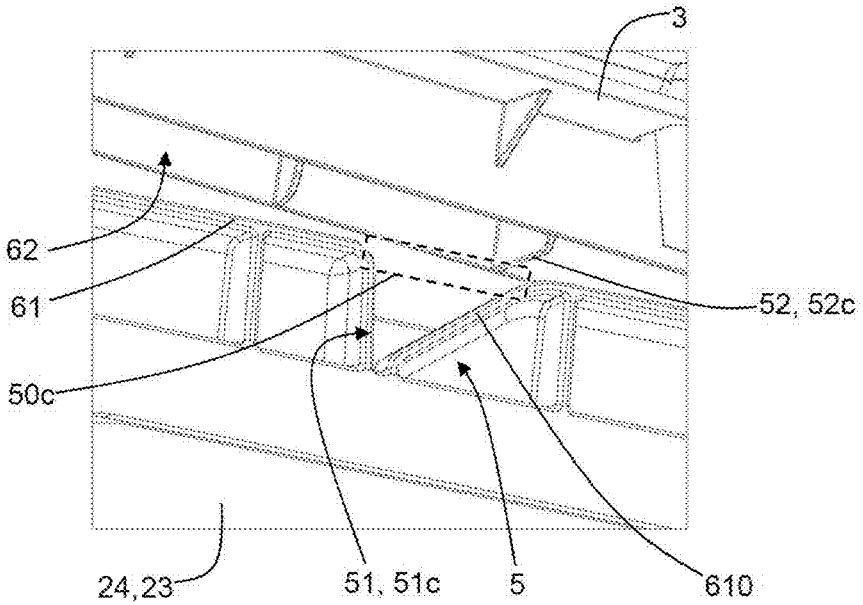

FOLDABLE PARCEL COMPRISING MEANS FOR GUIDING A COVER

CROSS-REFERENCE TO RELATED APPLICATIONS

The present application is a national stage entry of International (PCT) Patent Application Number PCT/EP2022/059486, filed Apr. 8, 2022, which claims priority to French Patent Application Number 2104210, filed Apr. 22, 2021, the complete disclosures of which are expressly incorporated herein by reference.

The field of invention is that of logistics.

More specifically, the invention relates to a package, also called a packing means, that is to say a container, for the routing of objects between two destinations.

To transport an object safely, packages such as plastic material boxes and cardboards are known.

Generally speaking, the packages comprise a case having a bottom and a peripheral rim which together define a stowage volume in which at least one object to be transported is housed.

The packages also comprise a movable lid relative to the case, or attached to the case, this lid being in particular able to adopt a closed position of the stowage volume in which the lid obturates the stowage volume of the case.

These packages are conventionally foldable. They are thus movable between a use configuration in which the case is formed and defines the stowage volume, and a flat configuration in which the package is collapsed on itself, and produces less space requirement.

More particularly, the peripheral rim comprises:

- a first panel;
- a second panel;
- a third panel opposite to the first panel;
- a forth panel opposite to the second panel.

Each panel can thus adopt:

- a stowage position in which it extends substantially parallel to the bottom;
- a use position in which it extends substantially perpendicularly to the bottom.

Prior to transporting an object, a user grabs a package in the flat configuration in order to shape it. Indeed, most often, when the package is in a storage situation, the panels of the peripheral rim are in their stowage position, which implies that the package is in the flat configuration.

The user must then shape the case, that is to say define the stowage volume by positioning each of the panels of the peripheral rim in its use position.

The user can then insert an object into the stowage volume and position the lid in the closed position of the stowage volume.

Commonly, the packages are made of cardboard. These cardboard packages are generally used for only one shipment or for a particularly limited number of shipments.

These cardboard packages tend to degrade particularly quickly depending on the handling conditions of these packages, as well as the environmental conditions to which they may be subjected.

Consequently, given the cardboard volumes used during logistical transports, it can be considered that the use of these cardboards is not ecological and is particularly resource-intensive, even by taking into account the simple and easy-to-produce nature of this type of package.

Recently, reusable package projects have emerged.

These reusable packages have the ability to be used many times before having to be recycled or repaired. To this end, these packages include walls formed of materials that are more resistant and more durable than the cardboard.

Ultimately, although having a more complex and more expensive design or manufacture than that of the cardboard packages, the ecological footprint of such reusable packages is better.

These reusable packages conventionally comprise integrated locking means, making it possible to lock the lid in a position obturating the access to the stowage volume.

The locking means can in particular take the form of anchor points and bolts intended to hook the anchor points. For example, one of the lid or of the case has a ring forming an anchor point, and the other of the lid or of the case has a cavity into which the ring is inserted in the closed configuration of the lid, the bolt being movably mounted inside the cavity to hook the ring and keep it captive in the cavity.

The use of reusable packages nevertheless raises certain problems.

In particular, one of the problems identified relates to the closing of the package.

Indeed, during the folding of the package, the lid may not move into its closed position and be locked correctly.

More specifically, problems in directly and correctly aligning the locking means during the closing of the lid were observed.

This alignment problem arises, among other things, from the very nature of the reusable packages which in particular implement for their panels materials likely to show deformations as they are used.

The invention aims in particular to overcome this drawback of the prior art.

More specifically, the invention aims to propose a reusable package which can be correctly closed and locked, on the first closing attempt made by a user, and this throughout the life of the package.

These aims, as well as others which will appear subsequently, are achieved thanks to the invention which relates to a package comprising:

- a bottom;
- panels, including a front panel, a rear panel, and two side panels pivotally mounted on the bottom;
- obturation means comprising a lid pivotally mounted on the rear panel via a rear pivot link; the package being foldable between:
- a use configuration in which at least the bottom, the front panel and the side panels form a case defining a stowage volume, and in which the obturation means are capable of closing the stowage volume;
- a flat configuration, in which the panels and the lid extend approximately parallel to the bottom;

the package also comprising means for locking the lid in a closed position of the stowage volume in the use configuration of the package, the locking means establishing, in a locking configuration, a mechanical link between an upper edge of the front panel and a front edge of the lid, characterized in that it comprises means for guiding the lid into its closed position, the guide means being distinct from the rear pivot link, the guide means being designed to force a displacement in abutment of the front edge of the lid against the upper edge of the front panel when the lid approaches its closed position.

Thanks to the package according to the invention, the closing of the lid is guided so that, during this closing, the front edge of the lid abuts against the upper edge of the front panel, and so that the locking means can directly lock the lid.

These guide means thus make it possible to compensate for the fact that the package according to the invention can be of the reusable type, that is to say the type that can be manufactured in materials likely to present, as the package is used, deformations, even minute ones, likely to limit the ability of the package to be able to be closed correctly on the first attempt by a user, without complex manipulation, or specifically aim to compensate for these deformations.

The guide means thus compensate for these possible deformations by constraining the lid so that it adopts a correct position following its closing.

According to one advantageous characteristic, the guide means comprise at least one pair of guide elements comprising:

a guide slide having a flared entrance;

a male guide element intended to be inserted and slide into the guide slide when the lid approaches its closed position.

Thanks to such guide elements, uncertainties in the position of the male guide element during the closing of the lid are compensated by the fact that the slide has a flared entrance.

Indeed, during the closing, the male guide element can penetrate into the flared entrance by presenting a variable position within the flared entrance, then the slide makes it possible to guide and bring this male guide element to its terminal position corresponding to the one that the male guide element must adopt when the lid is in its closed position.

According to one advantageous embodiment, the guide means comprise two deployable guide arms each extending between a first end and a second end, each guide arm being movably coupled in rotation to the lid by its first end, at level of a coupling point located in the immediate vicinity of the front edge and of one of the side edges of the lid, and the guide means comprise a main pair of guide elements for each guide arm, each main pair comprising:

a main slide extending on an inner face of the side panel in the immediate vicinity of said guide arm;

a main male element located at the second end of said guide arm.

Thanks to this embodiment, the guide arms make it possible to form a pre-guiding of the lid even though it is in a position relatively away from the closed position that it must reach.

Indeed, these guide arms deploy under the lid to make it possible to position remotely from the lid each main male element intended to be inserted and to slide in its main slide.

This positioning of each main male element remotely from the lid, on a guide arm which is movable relative to the lid, can lead to errors in the positioning of the main male element relative to the main slide. These positioning errors are advantageously compensated by the flared entrance of each main slide.

Advantageously, each guide arm forms part of a deformable parallelogram coupled to the rear panel.

The position of the guide arm and its deployment are thus imposed by the respective position of the rear panel and of the lid.

Consequently, the rotation of the rear panel relative to the bottom, and the rotation of the lid relative to the rear panel make it possible to precisely position each of the arms with respect to their main slide, and each of the main pairs of guide elements.

According to one advantageous solution, the guide means comprise two terminal pairs of guide elements each comprising:

a terminal slide extending on an inner face of one of the side panels in the immediate vicinity of the upper edge of the front panel and of the front edge of the lid in the use configuration of the package with the lid in its closed position;

a male terminal element coupled to the lid by being located in the immediate vicinity of the front edge of the lid.

These two terminal pairs of guide elements make it possible to perform a more specific guiding in a final phase where the lid approaches the closed position.

In addition, by being located in the immediate vicinity of the upper edge of the front panel and of the front edge of the lid, these two terminal pairs ensure that the front edge of the lid abuts perfectly against the upper edge of the front panel.

Advantageously, each male terminal element is carried by the first end of one of the guide arms.

In this way, the male terminal elements benefit from the guiding performed by the main pair(s) of guide elements.

The guiding in the final phase where the lid approaches the closed position is thus optimized.

Preferably, each male terminal element is provided with a corrector designed to prevent its insertion into a main slide.

In this way, the insertion of the male terminal element(s) into the main slide(s) is avoided.

The benefit provided by the fact that the male terminal element(s) are carried by the first end(s) of the guide arm is thus not reduced by the possibility that these male terminal elements can be inserted into the main slides.

According to one advantageous variant, the guide means comprise two intermediate pairs of guide elements each comprising:

an intermediate slide;

an intermediate male element, the intermediate slide and the intermediate male element being respectively located along a central portion of a side edge of the lid and along a central portion of an upper edge of a side panel, or vice versa.

These intermediate pairs of guide elements thus make it possible to perform a guiding at the level of an intermediate portion of the lid thus ensuring, during a prior phase where the lid approaches the closed position, that the lid is sufficiently advanced towards the front panel of the package.

Preferably, for each intermediate pair of guide elements, the package cmprises:

a longitudinal tab having a notch forming the intermediate slide;

a longitudinal groove having a transverse rib forming the intermediate male element, the longitudinal tab being inserted into the longitudinal groove in the closed position of the lid.

In this way, when the lid reaches its closed position then the longitudinal tabs are inserted into the longitudinal grooves which allows, in addition to providing a lateral guiding of the lid relative to the side panels, to allow the lid to present significant lateral support.

Other characteristics and advantages of the invention will appear more clearly upon reading the following description of preferred embodiments of the invention, given by way of illustrative and non-limiting examples, and the appended drawings among which:

FIG. 1 is a schematic perspective top representation of a package according to a first embodiment of the invention, in a flat configuration;

FIG. 2 is a schematic perspective top representation of part of the package according to the first embodiment of the invention, in an unfolded use configuration where a case defining a stowage volume is shaped, the case being formed by a bottom, a front panel and the side panels of the package, and where obturation means comprising a lid and a rear panel of the package are in an open position;

FIG. 3 is a simplified schematic perspective top representation of the package according to a second embodiment of the invention, in its use configuration, in which the case is formed by the bottom, the front panel, the side panels and also by the rear panel, and in which the obturation means comprising only the lid are in an open position;

FIG. 4 is a simplified schematic perspective top representation of the package according to the invention, in its use configuration, in which the case is formed, and where the obturation means are in a closed position and obturate the stowage volume;

FIG. 5 is a detailed perspective top view, illustrating part of the package locking means according to the invention;

FIG. 6 is a detailed perspective top view, illustrating another part of the package locking means according to the invention;

FIG. 7 is a detailed view illustrating means for guiding the lid of the package according to the invention, including in particular part of a guide arm carrying a male guide element, and a guide slide located on an inner face of the side panel of the package;

FIG. 8 is a detailed view from another angle of view of the guide means illustrated in FIG. 7;

FIG. 9 is a detailed view of another type of a male guide element of the guide means;

FIG. 10 is a detailed schematic perspective top representation, illustrating another type of a guide slide of the guide means, complementary to the male guide element of FIG. 9;

FIG. 11 is a schematic representation of a detail of the package according to the invention, illustrating in side view the guide means illustrated in FIGS. 9 and 10, the lid of the package being in a final phase of approaching its closed position;

FIG. 12 is a detailed schematic perspective top representation of a third type of a package guide means according to the invention;

FIG. 13 is a detailed perspective bottom view of the guide means illustrated in FIG. 12.

With reference to FIGS. 1 to 4, a package 1 according to the invention is represented.

This package 1 comprises a bottom 20, panels 24, and a lid 3.

The panels 24 comprise in particular:

a front panel 21;

a rear panel 22;

two side panels 23.

With reference to FIG. 2:

the front panel 21 comprises an upper edge 211, a lower edge, and two side edges 213;

the rear panel 22 comprises an upper edge, a lower edge, and two side edges;

each side panel 23 comprises an upper edge 231, a lower edge, a front side edge 233 and a rear side edge 234.

The lid 3 comprises a front edge 31, a rear edge 32 and two side edges 33.

The panels 24 are pivotally mounted on the bottom 20.

Each of the panels 24 is pivotally coupled on the bottom 20 by its lower edge.

The lid 3, as illustrated in FIGS. 1 to 4, is pivotally mounted on the rear panel 22 via a rear pivot link 320.

The lid 3 is in particular coupled to the upper edge of the rear panel 22 by its rear edge 32.

As illustrated in FIGS. 1 to 4, the package 1 is of the folding type.

For this purpose, it can in particular adopt a flat configuration (illustrated in FIG. 1) and a use configuration (illustrated in FIGS. 2, 3 and 4).

With reference to FIG. 1, the package 1 is in its flat configuration. In this flat configuration, the panels 24 and the lid 3 extend substantially parallel to the bottom 20.

In particular, the rear panel 22 extends in continuity with the bottom 20. The side panels 23 (not visible) are folded down onto the bottom 20. The lid 3 is folded down onto the rear panel 22 and the bottom 20, overlapping the side panels 23. Finally, the front panel 21 is pivoted and folded onto the bottom 20, and partially covers the side panels 23.

With reference to FIGS. 2, 3 and 4, the package 1 is in its use configuration.

FIG. 2 illustrates a first embodiment and FIG. 3 illustrates a second embodiment.

Indeed, the package 1 comprises obturation means which comprise the lid 3.

According to the first embodiment, the obturation means also comprise the rear panel 22.

On the contrary, according to the second embodiment, the obturation means do not comprise the rear panel 22 and only comprise the lid 3.

In the use configuration according to the first embodiment, the bottom 20, the front panel 21 and the side panels 23 form a case which defines a stowage volume.

In this use configuration, it is in particular observed that the side edges 213 of the front panel 21 are in contact with the front side edges 233 of the side panels 23.

In the use configuration according to the second embodiment, the bottom 20, the front panel 21, the side panels 23 and the rear panel 22 form the case which defines the stowage volume.

In this use configuration, it is observed in particular that:

the side edges 213 of the front panel 21 are in contact with the front side edges 233 of the side panels 23, and the rear side edges 234 of the side panels 23 are in contact with the side edges of the rear panel 22.

In these use configurations, the obturation means can close the stowage volume.

Indeed:

with reference to FIG. 2, the lid 3 and the rear panel 22 are both in an open position authorizing access to the stowage volume;

with reference to FIG. 3, the lid 3 is in an open position authorizing access to the stowage volume.

As illustrated in FIG. 4, the lid 3, and more generally the obturation means, are in a closed position and thus prevent access to the stowage volume.

As detailed below, in the use configuration of the package 1, with its lid 3 in the closed position, the front edge 31 of the lid 3 is in contact with the upper edge 211 of the front panel 21. In addition, the side edges 33 of the lid 3 are in contact with the upper edges 231 of the side panels 23.

More specifically, when the lid 3 is in the closed position, the front edge 31 of the lid 3 is in abutment against the upper edge 211 of the front panel 21.

With reference to FIGS. 5 and 6, the package 1 also comprises means for locking 4 the lid 3 in its closed position.

These locking means 4 (also referred to as "means for locking" in respect to FIGS. 5 and 6) comprise, according to the present embodiment:

a locking ring 41 carried by the lid 3 and protruding from this lid 3;

a receiving housing 42 for receiving and hooking the locking ring 41, presented by the front panel 21.

These locking means 4 are more specifically presented by faces of the front panel 21 and of the lid 3 which face each other and are in the immediate vicinity of each other when the lid 3 is in the closed position.

In the closed position of the lid 3, and in other words in a locking configuration, the locking ring 41 is inserted inside the receiving housing 42, and is hooked inside this receiving housing 42 to keep the locking ring 41 captive.

The locking means 4 thus establish, in this locking configuration, a mechanical link between the upper edge 211 of the front panel 21 and the front edge 31 of the lid 3.

In other words, in the locking configuration of the locking means 4, the upper edge 211 of the front panel 21 is secured to the front edge 31 of the lid 3.

These locking means 4 are in particular of the type actuated by contact. That is to say the locking ring 41 can be freely inserted into the receiving housing 42 up to a position completely inserted into this receiving housing 42, a position in which the hooking is actuated automatically, de facto achieving the mechanical link.

For example, a hook can be designed to move away from the receiving housing 42 during the insertion of the locking ring 41 and be designed to return to a position in which it hooks the locking ring 41 once this locking ring 41 is completely inserted into the receiving housing 42. This repositioning of the hook in its hooking position is performed for example under the effect of elastic return means.

With reference to FIGS. 3, and 7 to 13, as well as according to the principle of the invention, the package 1 comprises means 5 for guiding the lid 3 into its closed position.

These guide means 5 are distinct from the rear pivot link 320.

The guide means 5 are designed to force a displacement in abutment of the front edge 31 of the lid 3 against the upper edge 211 of the front panel 21 when the lid 3 approaches its closed position.

The guide means 5 are multiple.

In a manner common to different types of guide means 5, these guide means 5 comprise pairs of guide elements composed of:

a guide slide 51;

a male guide element 52 intended to be inserted and slide into the guide slide 51 when the lid 3 approaches its closed position.

As detailed below and according to the present embodiment, the guide means 5 comprise more specifically:

at least one main pair of guide elements;

at least one terminal pair of guide elements;

at least one intermediate pair of guide elements.

The guide slides 51 have a flared entrance 50*a*, 50*b*, 50*c*.

In other words, these guide slides 51 extend from their entrance 50*a*, 50*b*, 50*c*, while narrowing until they present a passage of a width corresponding specifically to the shape of the male guide element 52 which is intended to be inserted and slide into the guide slide 51.

These guide slides 51 thus have a funnel shape guiding, as the male guide element 52 is inserted, its displacement to ensure that it always adopts the same position once completely inserted into the guide slides 51.

As illustrated in FIGS. 6, 7, 8 and 12, the guide means 5 comprise two guide arms 53.

These guide arms 53 are deployable. In particular, these two guide arms 53 can fold under the front panel 21 when the package 1 is in its flat configuration. It can be envsiaged, according to another mode of operation, that the guide arms 53 fold under the lid 3 when the package 1 is in its flat configuration.

These guide arms 53 deploy when the package 1 is unfolded and placed in its use configuration, and also when the position of the lid 3 is modified, in particular when the lid 3 is moved so that it reaches its closed position.

Each guide arm 53 extends between a first end 531 and a second end 532.

With reference to FIGS. 3, 11 and 12, each guide arm 53 is movably mounted in rotation to the lid 3 by its first end 531 at the level of a coupling point 5310. These coupling points 5310 are respectively located in the immediate vicinity of the front edge 31 and of each side edge 33.

In other words, the two coupling points 5310 are located at the two corners of the lid 3 located at the level of the front edge 31 of the lid 3.

According to the present embodiment and with reference to FIG. 3, each guide arm 53 forms part of a deformable parallelogram coupled to the rear panel 22.

By deformable parallelogram, it is understood that the guide arms 53 have in particular pivot links at its two ends, and that a longitudinal element is coupled to the pivot point presented by the second end 532 of the coupling arms 53 and to the rear panel 22 by another pivot link.

Consequently, the position of the guide arms 53 is dictated by the angle formed between the rear panel 22 and the lid 3.

With reference to FIGS. 3, 7, 8, and as mentioned previously, the guide means 5 comprise a main pair of guide elements, for each guide arm 53.

Each main pair of guide elements comprises a main slide 51*a*, and a main male element 52*a*.

The main slide 51*a* extends on an inner face of one of the side panels 23.

In particular, this main slide 51*a* extends in the immediate vicinity of one of the guide arms 53 in the use configuration of the package 1, with the lid 3 in its closed position.

The main male element 52*a* is located at the second end 532 of the guide arm 53 which is in the immediate vicinity of the main slide 51*a*, in the use configuration of the package 1, with the lid 3 in its closed position.

This main male element 52*a* has a shape intended to be inserted at least partially inside the main slide 51*a*, through its flared entrance 50*a*.

This main male element 52*a*, as it progresses in the main slide 51*a*, becomes captive of this main slide 51*a* until it reaches its terminal position at the bottom of the main slide 51*a*.

This progression of the main male element 52*a* in the main slide 51*a* generates a guiding of the lid 3.

With reference to FIGS. 3, 9, 10 and 11, and as mentioned previously, the guide means 5 also comprise two terminal pairs of guide elements.

Each terminal pair of guide elements comprises a terminal slide 51*b* and a male terminal element 52*b*.

The terminal slides 51*b* each extend on an inner face of each of the side panels 23.

These terminal slides 51*b* extend in particular in the immediate vicinity of the upper edge 211 of the front panel 21 and of the front edge 31 of the lid 3 in the use configuration of the package 1, when the lid 3 is in its closed position.

In other words, the terminal slides 51*b* are located in the immediate vicinity of the corner of a side panel 23 where the upper edge 231 and the front side edge 233 which is intended to come into contact with the front panel 21 intersect.

The male terminal element 52*b* is for its part coupled to the lid 3 by being located in the immediate vicinity of the front edge 31 of the lid 3.

More specifically, each male terminal element 52*b* is carried by the first end 531 of one of the guide arms 53. In particular, the male terminal elements 52*b* are presented on one face of each guide arm 53 which is oriented to face the directly adjacent side panel 23, in the use configuration of the package 1.

According to one embodiment not represented, the male terminal elements 52*b* can each be provided with a corrector preventing the insertion of the male terminal element 52*b* into one of the main slides 51*a*.

This corrector is for example produced by a difference in shape between the terminal element 52*b* and the main male element 52*a*.

The male terminal element 52*b* would then have a width and an end incompatible with the flared enrance of the main slide 51*a*.

According to the present embodiments, each terminal pair of guide elements makes it possible to compensate for any deformation of the lid 3 by forcing the abutment of the front edge 31 of the lid 3 with the upper edge 211 of the front panel 21 by pushing, or by pulling the front end of the lid 3 towards the front of the package 1, when a user closes the package 1.

Finally, with reference to FIGS. 12 and 13, and as mentioned previously, the guide means 5 also comprise two intermediate pairs of guide elements each comprising an intermediate slide 51*c* and an intermediate male element 52*c*.

The two intermediate slides 51*c* are respectively located along a central portion of the upper edge 231 of each of the side panels 23.

For their part, the intermediate male elements 52*c* are located along a central portion of each side edge 33 of the lid 3.

More specifically, the package 1 comprises:

two longitudinal tabs 61 each carried by one of the side panels 23, in particular at the level of the upper edge 231 of each side panel 23;

two longitudinal grooves 62 presented by the lid 3.

The longitudinal tabs 61 are intended to be inserted into the longitudinal grooves 62 in the closed position of the lid 3.

As illustrated in FIGS. 12 and 13, each longitudinal tab 61 has a notch 610 forming the intermediate slide 51*c*, and each longitudinal groove 62 has a transverse rib forming the intermediate male element 52*c*.

The intermediate slides 51*c* are of course directed so as to create traction of the lid 3 forwards during the engagement of the intermediate male elements 52*c* in the intermediate slides 51*c*.

The closing of the lid 3, and more generally of the obturation means, causes the insertion and the sliding of the transverse rib inside the flared entrance 50*c* of the notch and thus the traction of the lid 3 forwards such that the rib arrives along the upper edge 231 of the side panel 23 at the level of the bottom of the notch.

Thanks to the guide means 5, the lid 3 is guided and pulled until it adopts a correct closed position, in particular with respect to the upper edge 211 of the front panel 21.

During the closing, the two guide arms 53 deploy initially and bring each of the main male elements 52*a* into an entrance 50*a* of each main slide 51*a*.

The progression of the closing of the lid 3 causes a quiding of the lid 3 by the main pairs of guide elements.

Towards the end of the closing of the lid 3, the intermediate pairs of guide elements and the terminal pairs of guide elements come into action, simultaneously or successively.

These last two pairs of guide elements make it possible, in combination with the main pairs of guide elements, to ensure that the lid 3 adopts a correct position relative to the side panels 23 and more specifically relative to the front panel 21.

In particular, these pairs of guide elements force the forward displacement of the lid 3 so that its front edge 21 abuts against the upper edge 211 of the front panel 21, and so that the locking means 4 can establish the locking of the package 1.

The invention claimed is:

1. A package comprising:

a bottom;

panels including a front panel, a rear panel, and two side panels pivotally mounted on the bottom;

obturation means comprising a lid pivotally mounted on the rear panel via a rear pivot link;

the package being foldable between:

a use configuration in which at least the bottom, the front panel and the two side panels form a case defining a stowage volume, and in which the obturation means are capable of closing the stowage volume;

a flat configuration, in which the panels and the lid extend generally parallel to the bottom;

the package also comprising locking means for locking the lid in a closed position of the stowage volume in the use configuration of the package, the locking means establishing, in a locking configuration, a mechanical link between an upper edge of the front panel and a front edge of the lid, wherein the package comprises guide means for guiding the lid into the closed position of the lid, the guide means being distinct from the rear pivot link, the guide means being configured to guide the front edge of the lid to abut against the upper edge of the front panel when the lid approaches the closed position of the lid and wherein the guide means comprise at least one pair of guide elements comprising:

a guide slide having a flared entrance;

a male guide element intended to be inserted and to slide into the guide slide when the lid approaches the closed position of the lid, and wherein the guide means comprise two deployable guide arms, each of said two deployable guide arms extending between a first end and a second end, each of said two deployable guide arms being rotatably coupled to the lid by the first end of the respective deployable guide arm of each of said two deployable guide arms, at the level of a coupling point located in the immediate vicinity of the front edge and a side edge of the lid, and wherein the guide means further comprise a main pair of guide elements for each guide arm of said two deployable guide arms, each main pair of guide elements comprising:

a main slide extending on an inner face of the side panel in the immediate vicinity of each of said two deployable guide arms;

a main male element located at the second end of each of said two deployable guide arms.

2. The package according to claim 1, wherein each of the deployable guide arms of said two deployable guide arms forms part of a deformable parallelogram coupled to the rear panel.

3. The package according to claim 1, wherein the guide means further comprise two terminal pairs of guide elements each comprising:

a terminal slide extending on an inner face of one of the side panels in the immediate vicinity of the upper edge of the front panel and of the front edge of the lid in the use configuration of the package with the lid in the closed position of the lid;

a male terminal element coupled to the lid and located in the immediate vicinity of the front edge of the lid.

4. The package according to claim 3, wherein each said male terminal element is carried by the first end of one of the guide arms.

5. The package according to claim 4, wherein each said male terminal element is provided with a corrector configured to prevent insertion of said male terminal element into the main slide.

6. The package according to claim 1, wherein the guide means further comprise two intermediate pairs of guide elements each comprising:

an intermediate slide;

an intermediate male element, the intermediate slide and the intermediate male element being respectively located along a central portion of a side edge of the lid and along a central portion of an upper edge of a side panel, or vice versa.

7. The package according to claim 6, wherein, for each intermediate pair of guide elements, the package comprises:

a longitudinal tab having a notch forming the intermediate slide;

a longitudinal groove having a transverse rib forming the intermediate male element, the longitudinal tab being inserted into the longitudinal groove when the lid is in its closed position.

* * * * *